US005701854A

United States Patent [19]

Hauser

[11] Patent Number: 5,701,854

[45] Date of Patent: Dec. 30, 1997

[54] AXIAL FAN FOR AN INTERNAL COMBUSTION ENGINE

[75] Inventor: Kurt Hauser, Stuttgart, Germany

[73] Assignee: Behr GmbH & Co., Stuttgart, Germany

[21] Appl. No.: 702,799

[22] Filed: Aug. 26, 1996

Related U.S. Application Data

[63] Continuation of Ser. No. 543,898, Oct. 17, 1995, abandoned.

[30] Foreign Application Priority Data

Oct. 26, 1994 [DE] Germany ..... 44 38 184.0

[51] Int. Cl.[6] ..... F04D 29/54

[52] U.S. Cl. ..... 123/41.49; 180/68.1; 415/208.1; 55/385.3; 416/189

[58] Field of Search ..... 123/41.49, 41.7; 180/68.1; 415/208.1, 223, 211.1; 416/169 A, 189, 192, 247 R; 55/385.3

[56] References Cited

U.S. PATENT DOCUMENTS

| | | | |
|---|---|---|---|
| 4,061,188 | 12/1977 | Beck | 415/207 |
| 4,181,172 | 1/1980 | Longhouse | 416/189 |
| 4,213,426 | 7/1980 | Longhouse | 123/41.49 |
| 4,329,946 | 5/1982 | Longhouse | 416/192 |
| 4,548,548 | 10/1985 | Gray, III | 416/189 |
| 4,685,513 | 8/1987 | Longhouse et al. | 123/41.49 |
| 4,768,472 | 9/1988 | Hayashi et al. | 123/41.49 |
| 5,131,352 | 7/1992 | Hoshino et al. | 416/247 R |
| 5,183,382 | 2/1993 | Carroll | 416/169 A |
| 5,236,301 | 8/1993 | Palmer | 415/116 |
| 5,427,502 | 6/1995 | Hudson | 415/208.1 |
| 5,522,457 | 6/1996 | Lenz | 180/68.1 |

FOREIGN PATENT DOCUMENTS

| | | | |
|---|---|---|---|
| 0026997 | 4/1981 | European Pat. Off. | 123/41.49 |
| 074019A1 | 3/1992 | European Pat. Off. . | |
| 2578589A1 | 9/1986 | France . | |
| 1428273 | 1/1969 | Germany . | |
| 1930809 | 12/1970 | Germany . | |
| 2352236A1 | 4/1975 | Germany . | |
| 7818243 | 2/1979 | Germany . | |
| 3128654A1 | 8/1982 | Germany . | |
| 3304297C2 | 3/1984 | Germany . | |
| 9016496 | 4/1991 | Germany . | |
| 4300577 | 7/1993 | Germany | 123/41.49 |
| 785501 | 10/1957 | United Kingdom . | |

*Primary Examiner*—David A. Okonsky
*Attorney, Agent, or Firm*—Evenson McKeown Edwards & Lenahan, PLLC

[57] ABSTRACT

An axial fan arrangement for the radiator of an internal combustion engine including an annular bypass channel terminating between the fan frame and the fan. The bypass channel is open to the pressure sided of the fan and is designed such that the bypass flow emerging on the intake side of the fan is deflected in the direction of the main flow. By these measures the stabilization of a back flow vortex is rendered unnecessary.

23 Claims, 3 Drawing Sheets

AXIAL FAN FOR AN INTERNAL COMBUSTION ENGINE

This application is a continuation of application Ser. No. 08/543,898, filed on Oct. 17, 1995, now abandoned.

BACKGROUND AND SUMMARY OF THE INVENTION

The invention relates to an axial fan for the radiator of an internal combustion engine, especially for a commercial/utility vehicle, said fan being provided with a fixed jacket surrounding the fan blades and with its intake side spaced a distance from a radiator frame mounted on the radiator. Axial fans of this type are known from German Utility Model 90 16 496. In such fan arrangements, the mouth of the outlet from the radiator frame is made nozzle-shaped, compressed in the vicinity of the space between the radiator frame and the fan, and given a diameter smaller than the fan diameter and the diameter of the fixed jacket surrounding the latter. This design ensures that the back flow vortex produced by the throttling of the flow emerging from the fan is caught in the vicinity of the leading edges of the fan blades and stabilized there so that it does not have any significant influence on the flow through the radiator. The air delivered in such designs is reduced, however, in an undesirable fashion by restricting the outlet cross section of the radiator frame.

It is also known from German Patent 33 04 297 to provide fans with a surrounding jacket fastened to the blade tips, to cause this jacket to project toward the radiator frame, and to associate a deflecting nozzle with this leading edge which ensures that the nozzle gap air is formed even under severe throttling conditions as an efflux for the main flow, so that formation of vortices is suppressed in this manner. In such designs, however, there is a relatively large depth of construction that can not always be realized. In addition considerable problems arise when it is necessary to change the V-belts, as may become necessary during operation.

An object of the invention is to design an axial fan of the type referred to above in such fashion that the need for stabilizing a back flow vortex is eliminated.

To achieve this object, in an axial fan of the type referred to above, it is proposed by the invention to cause an annular bypass channel to terminate between the radiator frame and the fan, said channel being open to the pressure side of the fan and having its inside wall facing the main flow guided through the frame provided with a curvature such that the bypass flow emerging on the intake side of the fan is deflected in the direction of the main flow. This design permits a closed bypass flow to which energy is supplied from the pressure side of the fan, said energy being capable of being transmitted to the intake side. By virtue of this measure, the formation of a back flow vortex in the vicinity of the outer edges of the fan blades can be avoided even in a design in which a fixed jacket surrounds the rotating fan blades.

In an improvement according to certain embodiments of the invention, the annular bypass channel can be formed by the rear wall of the frame and a second wall located at a distance behind it, said second wall being supported by ribs on the rear wall of the frame that are distributed over the circumference. By virtue of these measures a relatively simple embodiment is obtained in practice. The ribs can be retrofitted in the frame with the second wall or manufactured integrally therewith. In another improvement according to certain embodiments of the invention, the lengthwise central plane of the ribs can be inclined at an angle to a radial plane running through them so that the ribs run in the direction in which the air enters that flows back from the pressure side of the fan and is provided with a twist. However, the ribs also ensure that the twist in the bypass flow is not disturbed and continues in the bypass flow which, as will be explained below, can contribute to noise reduction.

In certain preferred embodiments of the invention, the ribs can have the cross section of a drop profile and be arranged so that their number and division differ from the number and division of the fan blades. These measures also result in a definite noise reduction and/or eliminate possible sources of noise.

In certain preferred embodiments of the invention, the radiator frame, as in the arrangement referred to above, can have the cross section of a drop profile and be arranged so that their number and division differ from the number and division of the fan blades. These measures also result in a definite noise reduction and/or eliminate possible sources of noise.

In certain preferred embodiments of the invention, the radiator frame, as in the species recited at the outset, can have on its side facing the jacket a nozzle-type constriction that has a smaller diameter at its end than the diameter of the fan and jacket at its inlet side. By virtue of this measure the bypass channel can be formed on at least one side by the mouth area of the radiator frame nozzle. It is important to keep in mind that the design of this nozzle-type outlet area of the radiator frame gives no consideration to flow stabilization of a back flow vortex, as was the case in the prior art. The reduction of the diameter is therefore not determined by the stabilization of the back flow vortex but can only be designed with an eye toward the size of the cross section of the bypass channel, so that there is no fear of a significant reduction of the air throughput.

In certain preferred embodiments of the invention, the bypass channel can be mounted not only on the radiator frame but also on the fixed jacket of the fan, and then, in an improvement on this idea, the real channel wall can be formed by the jacket and the anterior channel wall can be connected with the radiator frame by an elastic sealing element, especially a sleeve.

In certain embodiments of the invention, finally, the inlet area of the bypass channel can be expanded funnelwise, and the curvature of the outlet area of the bypass channel can be made in the form of an arc, because this results in an especially simply manufactured shape that is also advantageous from the standpoint of flow technology. In an improvement on the invention, finally, the tangent that runs at the forward channel edge of the bypass channel at the end of its outlet curvature can be inclined parallel to the fan axis, or in another variation, at an angle outward that differs from the axial direction of the fan, so that the bypass flow is deflected into the area of the blade tips. Since the bypass flow, as stated earlier, enters with a certain amount of twist, in this embodiment the bypass flow can counteract the flow around the blade that occurs because of the pressure conditions at the blade tips. This results in a certain improvement in efficiency and reduction of the noise generated.

Other objects, advantages and novel features of the present invention will become apparent from the following detailed description of the invention when considered in conjunction with the accompanying drawings.

DETAILED DESCRIPTION OF THE DRAWINGS

Figure 1:
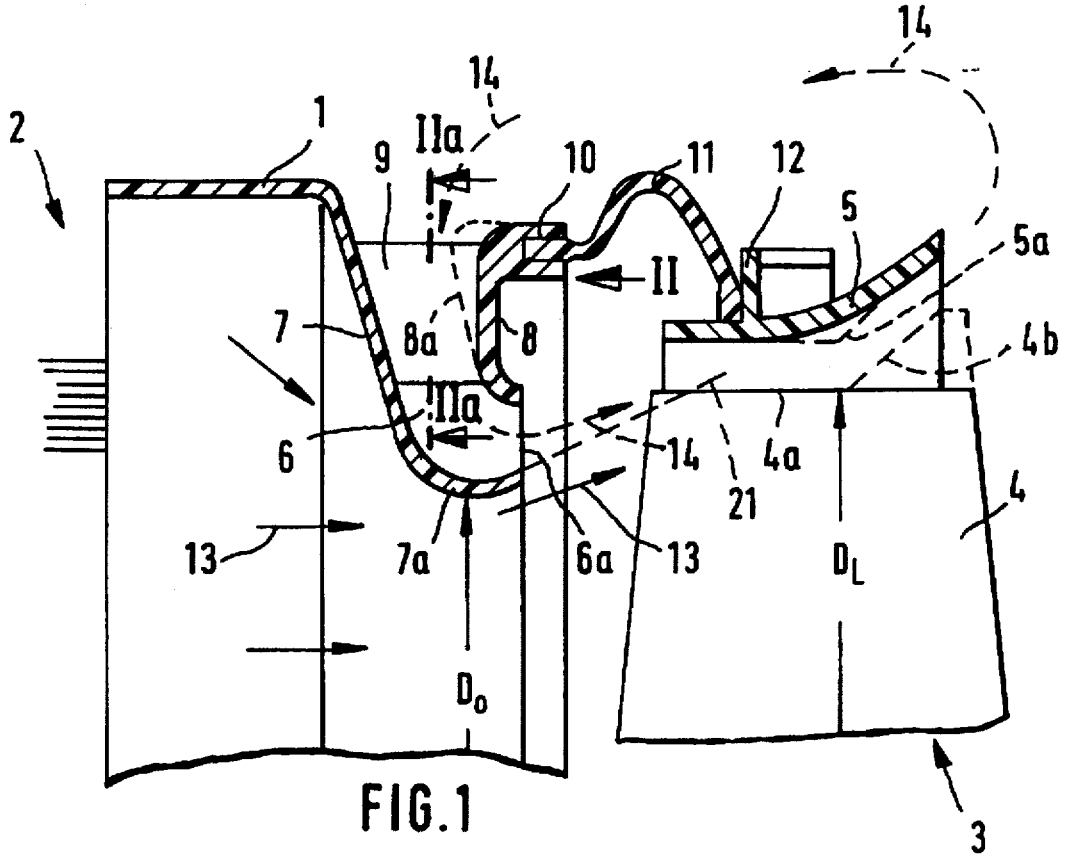
FIG. 1 is a schematic lengthwise section through the outer area of an axial fan designed according to the invention with a fan frame and a bypass channel.
Figure 2:
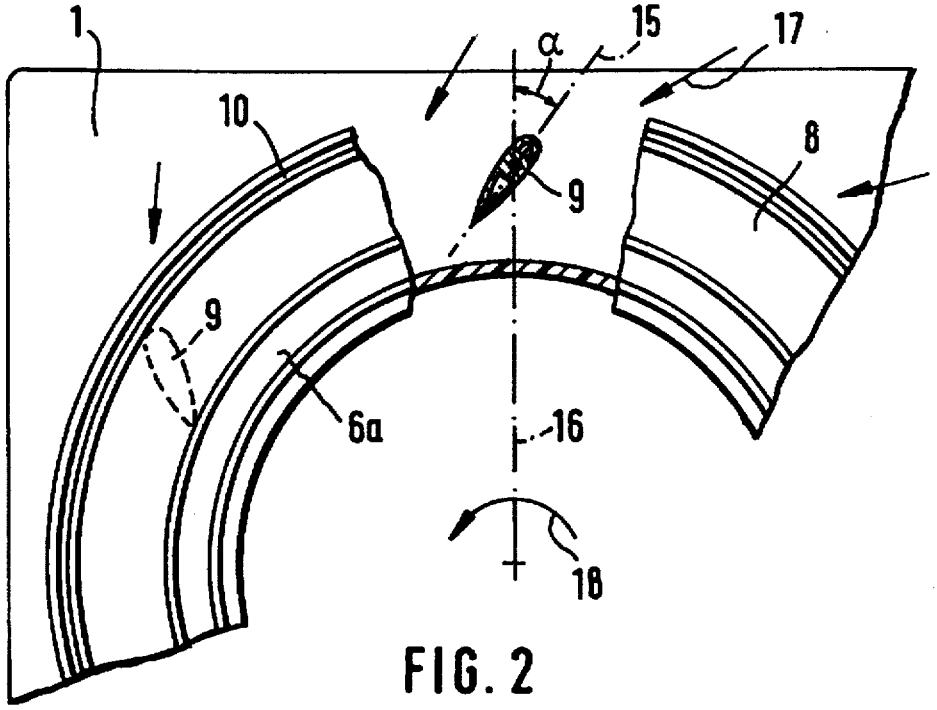
FIG. 2 is a view of part of the fan frame with a bypass channel looking in the direction of arrow II, with a partial area being cut along line IIa—IIa.

In FIGS. 1 and 2, an axial fan arrangement is shown for the radiator of an internal combustion engine, a commercial vehicle in the example shown, said arrangement consisting of a radiator frame associated with a radiator 2 that is not shown in greater detail, and an axial fan 3 located behind this frame 1. Blades 4 of axial fan 3, which have a diameter $D_L$, are surrounded by a jacket 5. Jacket 5, in a manner not shown in greater detail, but in the same fashion as axial fan 3, is permanently connected with the engine which is not shown but is located at the right behind axial fan 3.

Radiator frame 1 according to the invention is provided with an annular bypass channel 6, whose mouth cross section 6*a* is directed toward fan 3. Bypass channel 6 is formed by the rear wall 7 of radiator frame 1, which makes a transition to a nozzle-shaped circular constriction 7*a* with a diameter $D_O$. In the embodiment shown, this nozzle-shaped arrangement of the back wall 7 has a shape resembling the arc of a circle, by which bypass channel 6 is also sealed off on its interior.

The other wall of the bypass channel is formed by a ring 8 connected with the aid of a plurality of ribs 9 permanently with rear wall 7 of radiator frame 1. The ring 8 including ribs 9 can consist of one piece which is mounted in a manner not shown in greater detail on frame 1. However, it is also contemplated to provide the frame 1 integrally with ribs 9 and mount ring 8 on them, for example by using clips. These embodiments are recommended because radiator frame 1, ribs 9, ring 8, and jacket 5 are preferably made of plastic.

Ring 8 has on its exterior a surrounding groove 10 and this groove is engaged by one end of an elastic annular lip seal 11, which abuts a circumferential bead 12 of jacket 5 and thus forms a movable seal between radiator 2 and its frame 1 and jacket 5 attached to the engine. Jacket 5 is expanded in the manner of a diffuser in the direction of flow.

Bypass channel 6 terminates in front of the intake side of fan and is open on its entire annular outer surface to the space surrounding the fan assembly, which in turn communicates with the pressure chamber formed behind fan 3. Bypass channel 6 thus connects the intake side of fan 3 with its pressure side, so that in addition to the main flow indicated by arrows 13 through radiator 2, there is also a closed bypass flow as indicated by the dotted arrow 14, namely in the embodiment shown, such that this bypass flow reaches the area of tips 4*a* of fan blades 4. This bypass flow thus receives energy from the pressure side of fan 3, which can be dissipated on the intake side. It has been found that with this measure, always in the vicinity of fan blades 4, no back flow vortex develops but bypass flow 14, precisely when the fan assembly must be operated in a highly throttled state because of the engine coupling which is conventional today, is reinforced by the energy coming from the pressure side and thus prevents the creation of a back flow vortex.

As shown in FIG. 1, the shape of bypass channel 6 can also be made to match the wall arrangement 8*a* shown in dashed lines. It is also contemplated to bend jacket 5 as indicated at 5*a* toward the rear so that it is round or angular and to make a transition to a diffuser according to certain preferred embodiments of the invention. The fan blades 4 can have a radial extension in their outlet area as indicated at 4*b*.

Figure 3:
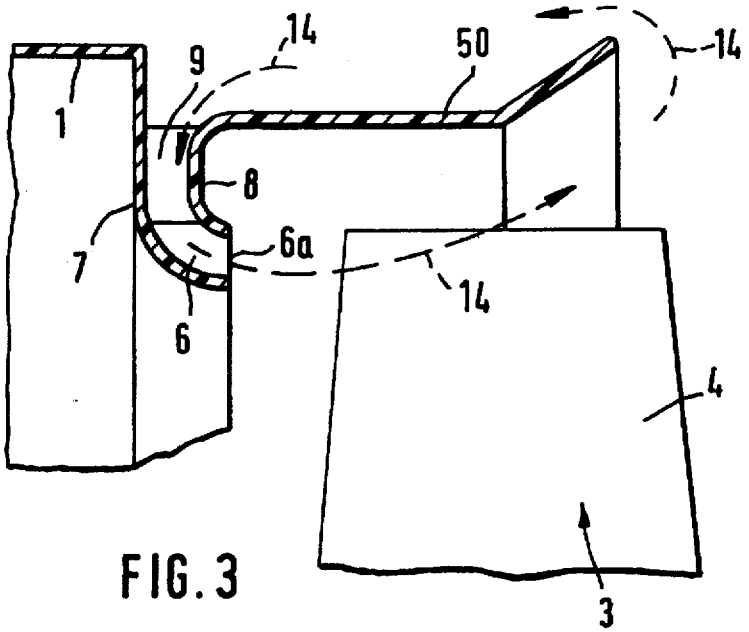
FIG. 3 is a schematic diagram of an axial fan arrangement similar to FIG. 1 but in a second preferred embodiment form.

FIG. 3 shows such a variation of a jacket shape 50, and here in contrast to the embodiment shown in FIG. 1, the ring 8 which is fastened by ribs 9 to the fan frame 1 and forms the rear wall of bypass channel 6 is a part of jacket 50 and therefore is not permanently mounted on the engine but is permanently connected with fan frame 1.

In both the embodiment of FIG. 1 and in the embodiment of FIG. 3, ribs 9 (see FIG. 2) have the flow-favoring cross section of a rain drop profile or a wing profile. This profile is arranged so that the lengthwise central plane 15 of each rib 9 that passes through the profile of ribs 9 is inclined at an angle $\alpha$ to a radial plane 16 that passes through the center of rib 9. The slope $\alpha$ corresponds to the direction 17 of the incoming flow which is determined by the direction of rotation 18. The ribs therefore constitute pitched flow guide profiles which ensure that the flow entering from the outside into bypass channel 6, which air, as indicated by arrows 17 has been subjected to a certain twist, also has a twist component when it is fed to fan 3 as indicated by the arrows 14 in FIG. 1. This will be discussed in greater detail in connection with FIG. 5.

Ribs 9 are uniformly distributed around the circumference of ring 8. Both their number and their spacing are selected so that they differ from the number and spacing of fan blades 4. For example if the fan has seven blades 4, six ribs 9 can be provided for example whose spacing at the circumference of ring 8 therefore differs from that of the fan blades. This measure contributes to noise reduction.

Figure 4:
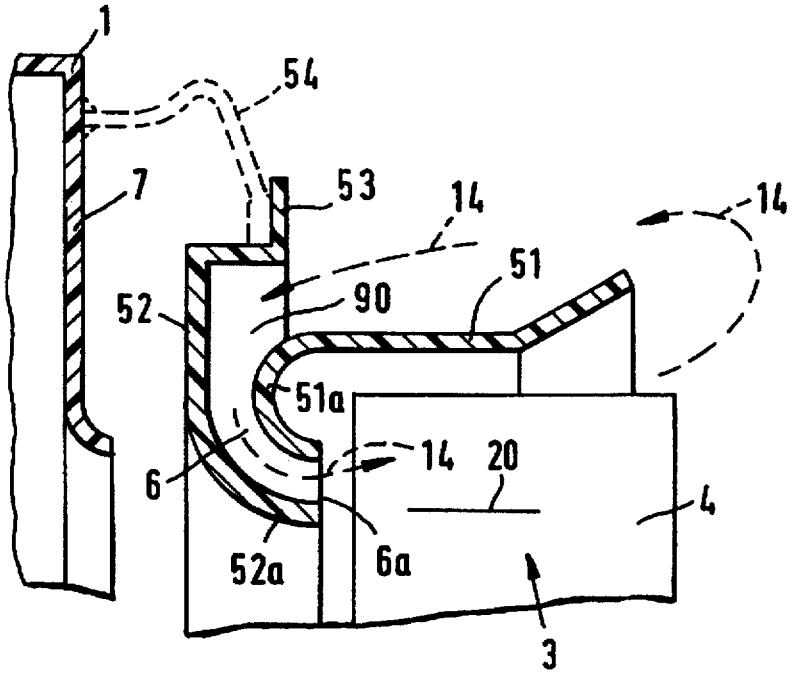
FIG. 4 is a view similar to FIG. 1 but in a third embodiment form.

FIG. 4 shows another variation of an embodiment according to the invention. Here a jacket 51 is associated with blades 4 of fan 3, said jacket being provided with a rounded area in the form of an arc 51*a* opposing the direction of flow. This rounded area 51*a* in this embodiment forms a rear wall of bypass channel 6 whose front wall in this case consists of a ring 52 which is connected by the blade-shaped ribs 90 permanently with jacket 51 or with its anterior rounded area 51*a*. This ring 52 has a surrounding contact edge 53 which is in turn abutted by the free edge of an elastic sealing lip 54, permanently connected with the rear wall 7 of fan frame 1. In this design also therefore a bypass flow 14 is produced which enters the vicinity of the tips of the fan blades 4. In this manner also a back flow vortex in the vicinity of fan blades 4 can be suppressed.

Figure 5:
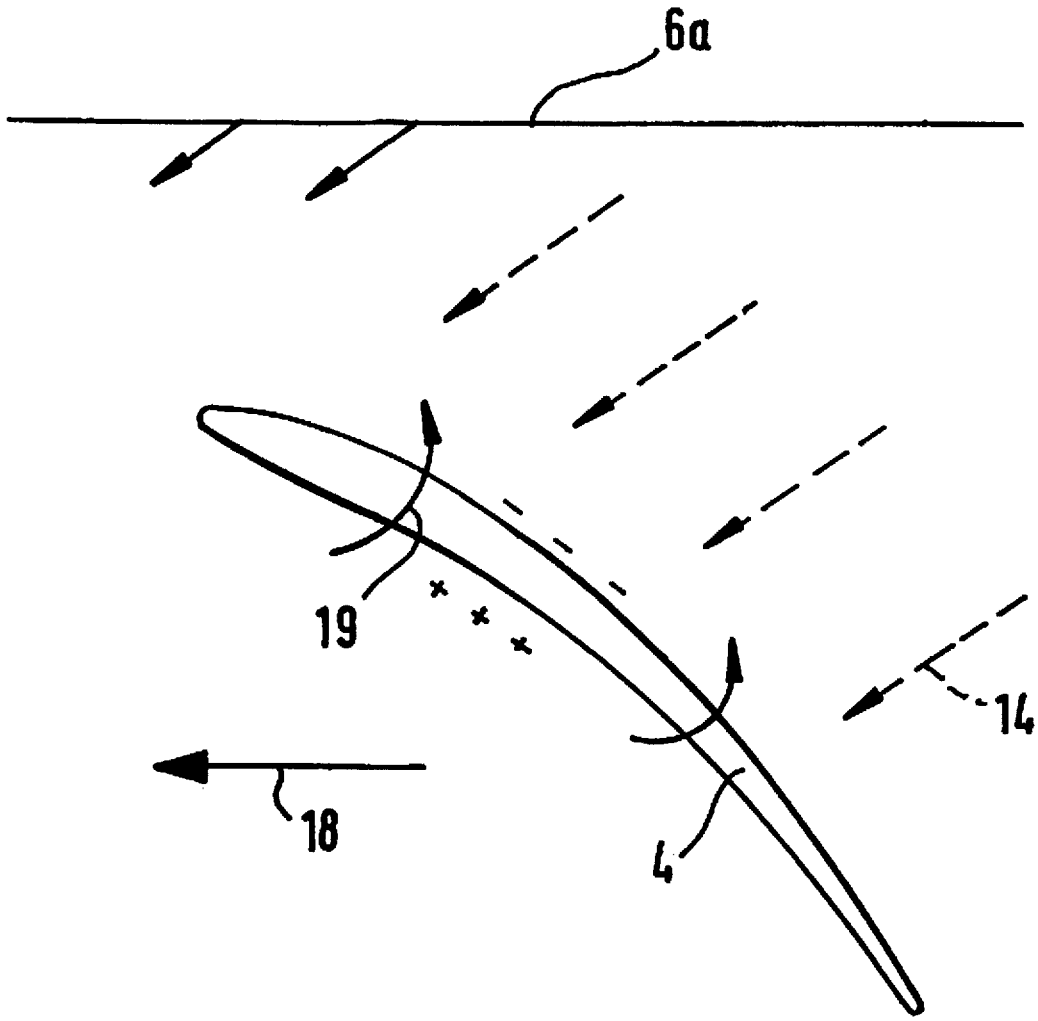
FIG. 5 is a schematic diagram of the flow against the blade tips that is generated by the bypass channel provided according to the invention.

FIG. 5 shows that the bypass flow in the direction of arrows 14 which is subject to a twist and which leaves opening 6*a* of the bypass channel 6, strikes the fan blades 4 turning in the direction of arrow 18 in their outer area such that the bypass flow 14 is opposed to the flow around the blade tips 19 which depends upon the pressure conditions. By virtue of the design according to the invention therefore the flow around the blades even in the outer area of the blades can be reduced or even prevented, which likewise contributes to improved performance and reduced noise.

What is claimed is:

1. Axial fan arrangement for the radiator of an internal combustion engine, comprising:

fan blades, and a fixed jacket surrounding the fan blades and mounted at a distance from a radiator frame mounted on a vehicle radiator, wherein an annular bypass channel terminates between the radiator frame and the fan, which bypass channel is open on a pressure side of the fan and whose inside wall facing a main flow guided through the frame has a curvature such that the bypass flow emerging on the intake side of the fan is deflected in the direction of the main flow.

2. Axial fan arrangement according to claim 1, wherein the annular bypass channel is formed by the rear wall of the frame and a second wall located at a distance behind said rear wall, said second wall being supported on the rear wall of the frame by ribs distributed around the circumference.

3. Axial fan arrangement according to claim 2, wherein an elastic sleeve is provided between the second wall and the jacket.

4. Axial fan arrangement according to claim 2, wherein respective lengthwise central planes of the ribs are inclined at an angle $\alpha$ to a radial plane running through them.

5. Axial fan arrangement according to claim 2, wherein the ribs have a cross section that has a water drop profile.

6. Axial fan arrangement according to claim 2, wherein the number and spacing of the ribs differs from the number and spacing of the fan blades.

7. Axial fan arrangement according to claim 2, wherein the radiator frame has a nozzle-shaped constriction on its side facing the jacket, said constriction having at its end a smaller diameter than the fan diameter and the jacket diameter on the inlet side.

8. Axial fan arrangement according to claim 1, wherein the bypass channel is mounted on a fixed jacket of fan.

9. Axial fan arrangement according to claim 8, wherein a rear channel wall is formed by the jacket, and wherein an anterior channel wall is connected with the radiator frame by an elastic sealing element.

10. Axial fan arrangement according to claim 1, wherein the inlet area of the bypass channel expands funnelwise.

11. Axial fan arrangement according to claim 1, wherein the curvature of the outlet area of the bypass channel is made in the form of an arc of a circle.

12. Axial fan arrangement according to claim 11, wherein a tangent that lies at a forward channel wall of the bypass channel at the end of its outlet curvature runs parallel to the fan axis.

13. Axial fan arrangement according to claim 12, wherein a tangent that lies at an anterior channel wall of the bypass channel at the end of its outlet curvature is inclined outward at an angle that differs from the axial direction of the fan.

14. Axial fan arrangement according to claim 2, wherein the jacket of the fan is made integral with the second wall of the bypass channel.

15. Axial fan arrangement according to claim 3, wherein the jacket is expanded in the manner of a diffuser in the outward flow direction.

16. Axial fan arrangement according to claim 15, wherein the fan blades have in their outlet area a radial extension corresponding to the jacket extension.

17. Axial fan arrangement according to claim 2, wherein the inlet area of the bypass channel expands funnelwise.

18. Axial fan arrangement according to claim 6, wherein the inlet area of the bypass channel expands funnelwise.

19. Axial fan arrangement according to claim 9, wherein the inlet area of the bypass channel expands funnelwise.

20. Axial fan arrangement according to claim 2, wherein the curvature of the outlet area of the bypass channel is made in the form of an arc of a circle.

21. Axial fan arrangement according to claim 6, wherein the curvature of the outlet area of the bypass channel is made in the form of an arc of a circle.

22. Axial fan arrangement according to claim 21, wherein a tangent that lies at a forward channel wall of the bypass channel at the end of its outlet curvature runs parallel to the fan axis.

23. Axial fan arrangement according to claim 22, wherein a tangent that lies at an anterior channel wall of the bypass channel at the end of its outlet curvature is inclined outward at an angle that differs from the axial direction of the fan.

* * * * *